US008881798B2

(12) United States Patent
Ramon et al.

(10) Patent No.: US 8,881,798 B2
(45) Date of Patent: Nov. 11, 2014

(54) REMOTE MANIPULATION AND CONTROL OF SUBTERRANEAN TOOLS

(75) Inventors: Michael Ramon, Houston, TX (US); Amy L. Farrar, Houston, TX (US); Ammar A. Munshi, Sugar Land, TX (US); Basil J. Joseph, Sugar Land, TX (US); Keven O'Connor, Houston, TX (US); Aubrey C. Mills, Magnolia, TX (US); Nathaniel Wagner, Spring, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 512 days.

(21) Appl. No.: 13/186,649

(22) Filed: Jul. 20, 2011

(65) Prior Publication Data

US 2013/0020092 A1 Jan. 24, 2013

(51) Int. Cl.
*E21B 43/00* (2006.01)
*E21B 23/00* (2006.01)
*E21B 23/01* (2006.01)

(52) U.S. Cl.
CPC ..... *E21B 23/01* (2013.01)
USPC ..... 166/53; 166/250.15; 166/65.1

(58) Field of Classification Search
CPC ..... E21B 21/10; E21B 34/066; E21B 47/09; E21B 47/12; E21B 23/01; E21B 23/03; E21B 23/06
USPC ..... 166/316, 318, 206, 209, 383, 53, 166/250.15, 65.1, 66.5
See application file for complete search history.

(56) References Cited

U.S. PATENT DOCUMENTS

| | | | | |
|---|---|---|---|---|
| 3,233,674 | A * | 2/1966 | Leutwyler | 166/63 |
| 3,264,994 | A | 8/1966 | Leutwyler | |
| 4,373,582 | A * | 2/1983 | Bednar et al. | 166/66.4 |
| 5,101,904 | A | 4/1992 | Gilbert | |
| 5,810,082 | A | 9/1998 | Jordan, Jr. | |
| 6,173,786 | B1 | 1/2001 | Sampson et al. | |
| 6,359,569 | B2 | 3/2002 | Beck et al. | |
| 6,364,037 | B1 | 4/2002 | Brunnert et al. | |
| 6,481,505 | B2 | 11/2002 | Beck et al. | |

(Continued)

FOREIGN PATENT DOCUMENTS

| | | |
|---|---|---|
| WO | 9315306 | 8/1993 |
| WO | 0177480 | 10/2001 |
| WO | 2004018833 | 3/2004 |
| WO | 2007036722 | 4/2007 |

*Primary Examiner* — Kenneth L Thompson
(74) *Attorney, Agent, or Firm* — Steve Rosenblatt

(57) ABSTRACT

A subterranean tool that is self contained for actuation can be run into a desired location on an automatic set mode controlled by a timer. If a problem develops in getting the tool to the desired location in time a magnetic field created by permanent or electro-magnets can be brought to bear on the tool to stop the timer before the tool actuates. Once the tool is subsequently positioned at the desired location another magnetic field can be brought to bear near the tool to set it. Alternatively, the tool can be run to the desired location without activation with the timer and then the magnetic field can be brought to the tool to set it. The magnetic field can be lowered to the tool with wireline or can be dropped or pumped past the tool to actuate the tool. Optionally the field can be generated from within an object that ultimately lands on a seat to provide a backup way to set the tool using tubing pressure.

31 Claims, 7 Drawing Sheets

(56) References Cited

U.S. PATENT DOCUMENTS

| | | | | |
|---|---|---|---|---|
| 6,497,280 | B2 | 12/2002 | Beck et al. | |
| 6,588,505 | B2 | 7/2003 | Beck et al. | |
| 6,624,759 | B2 | 9/2003 | Tubel et al. | |
| 6,851,481 | B2 | 2/2005 | Vinegar et al. | |
| 7,108,073 | B2 | 9/2006 | Patel | |
| 7,216,713 | B2 | 5/2007 | Read, Jr. | |
| 7,237,616 | B2 | 7/2007 | Patel | |
| 7,252,152 | B2 | 8/2007 | LoGiudice et al. | |
| 7,367,405 | B2 | 5/2008 | Murray | |
| 7,385,523 | B2 * | 6/2008 | Thomeer et al. | 340/854.8 |
| 7,438,130 | B2 | 10/2008 | Read, Jr. | |
| 7,503,398 | B2 | 3/2009 | LoGiudice et al. | |
| 7,562,712 | B2 | 7/2009 | Cho et al. | |
| 7,591,319 | B2 | 9/2009 | Xu | |
| 7,806,179 | B2 | 10/2010 | Coronado et al. | |
| 7,836,956 | B2 | 11/2010 | Smithson et al. | |
| 7,971,651 | B2 | 7/2011 | Tanju et al. | |
| 8,286,717 | B2 * | 10/2012 | Giroux et al. | 166/382 |
| 2007/0289473 | A1 | 12/2007 | Bussear | |
| 2008/0023229 | A1 | 1/2008 | Richards et al. | |
| 2009/0139722 | A1 | 6/2009 | Bussear et al. | |
| 2009/0139822 | A1 | 6/2009 | Yoo | |
| 2009/0146835 | A1 * | 6/2009 | Xu et al. | 340/854.3 |
| 2009/0229832 | A1 | 9/2009 | King | |
| 2010/0126716 | A1 | 5/2010 | Joseph | |
| 2011/0168403 | A1 | 7/2011 | Patel | |

* cited by examiner

REMOTE MANIPULATION AND CONTROL OF SUBTERRANEAN TOOLS

FIELD OF THE INVENTION

The field of the invention is tools operated at a subterranean location with an applied magnetic field that also have an automatic timed actuation feature and an ability to pause actuation if there are issues that delay placement while offering the ability to subsequently shift from pause mode to actuation mode when the tool is at the desired location.

BACKGROUND OF THE INVENTION

Subterranean tools need to be put into position into a wellbore before they are actuated. One such tool is a packer, which is used to isolate between or among zones for a variety of reasons including well control and production. Depending on the depth that the packer is to be set and assuming no unforeseen problems in running the packer to the target depth it is possible to have a packer automatically set after an allotted time on a timer that is tied to the setting mechanism. There are a variety of known ways to set a packer such as by using wellbore hydrostatic pressure, relative movement induced in a variety of ways, expansion and inflation, to name a few ways.

Triggering such setting of the packer can involve a locking mechanism that is unlocked such as for example with a magnetic field generated by a permanent magnet that is pumped downhole using opposed packing elements 76 and 78 as shown in FIG. 1 of U.S. Pat. No. 3,264,994. In other designs a wireline delivers a permanent or electromagnet that when brought in close proximity to the tool changes the physical properties of fluid in the tool so that flow is enabled so that the tool can be set. This design is shown in US Publication 2010/0126716.

The present invention relates to tools that can be triggered to set on a timer that can be stopped if there is a problem in getting the tool into position within the preset time. The system also has the capability of having the timer restarted to count off the remaining time or to go immediately to actuate the setting mechanism for the tool. In the preferred embodiment the tool is a packer that is set with a reaction that generates gas pressure to create the movement to set the packer. The reaction is preferably initiated by the application of a magnetic field that triggers a valve to open to allow the reactants to mix to generate the gas that sets the packer. The magnetic field can be brought in close proximity with the tool with a permanent or electromagnet that can be delivered either on wireline or slickline or can be mounted internally to an object such as a ball or a plug that can reach the tool by gravity in a vertical well or can be aided in moving to the desired location with circulation. Optionally, the object transporting the magnet can land on a seat in the string that was used to place the packer to provide an emergency capability to set the packer with pressure on the seated object.

Those skilled in the art will better appreciate the details of the invention from a review of the preferred embodiment description and associated drawings while recognizing that the full scope of the invention is to be determined from the appended claims.

SUMMARY OF THE INVENTION

A subterranean tool that is self contained for actuation can be run into a desired location on an automatic set mode controlled by a timer. If a problem develops in getting the tool to the desired location in time a magnetic field can be brought to bear on the tool to stop the timer before the tool actuates. Once the tool is subsequently positioned at the desired location another magnetic field can be brought to bear near the tool to set it. Alternatively, the tool can be run to the desired location without activation with the timer and then the magnetic field can be brought to the tool to set it. The magnetic field can be lowered to the tool with wireline or can be dropped or pumped past the tool to actuate the tool. Optionally the field can be generated from within an object that ultimately lands on a seat to provide a backup way to set the tool using tubing pressure in the string used to place the tool.

DETAILED DESCRIPTION OF THE PREFERRED EMBODIMENT

Referring to FIG. 2*a*-*e*, there are two chambers 10 and 12 separated by a valve 14. Valve 14 has a control system 16 shown schematically in FIG. 3 that has a timer T. The timer T can be set to a specific time when running in so that when the time has elapsed the valve 14 will open and the tool 18 will set. On the other hand the timer T, if actuated before running in, can be stopped by bringing in a magnetic field having a predetermined characteristic so that the control system will recognize the field and shut off the countdown to setting the tool 18. This can happen if more time is needed than set into the timer T to get the tool 18 into position. Once the tool 18 is put into position then preferably a discrete magnetic field can be brought into the vicinity of the control system 16 and trigger the valve 14 to open and set the tool.

Figure 3:
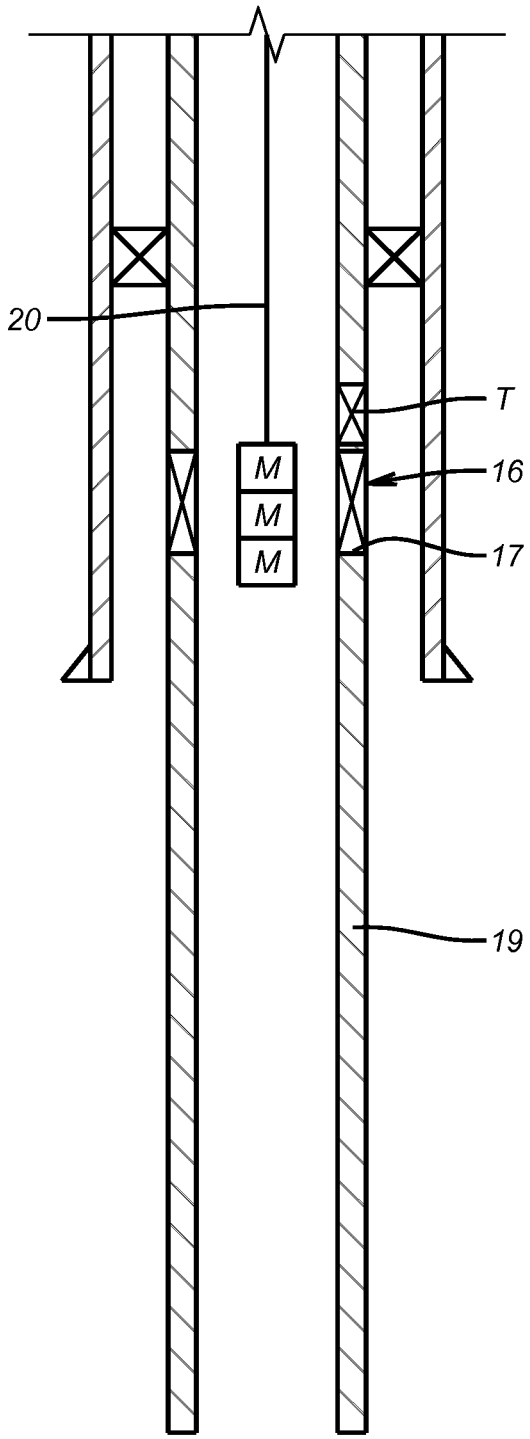
FIG. 3 shows activation or pausing automatic operation with a magnetic field delivered on wireline.
Figure 4:
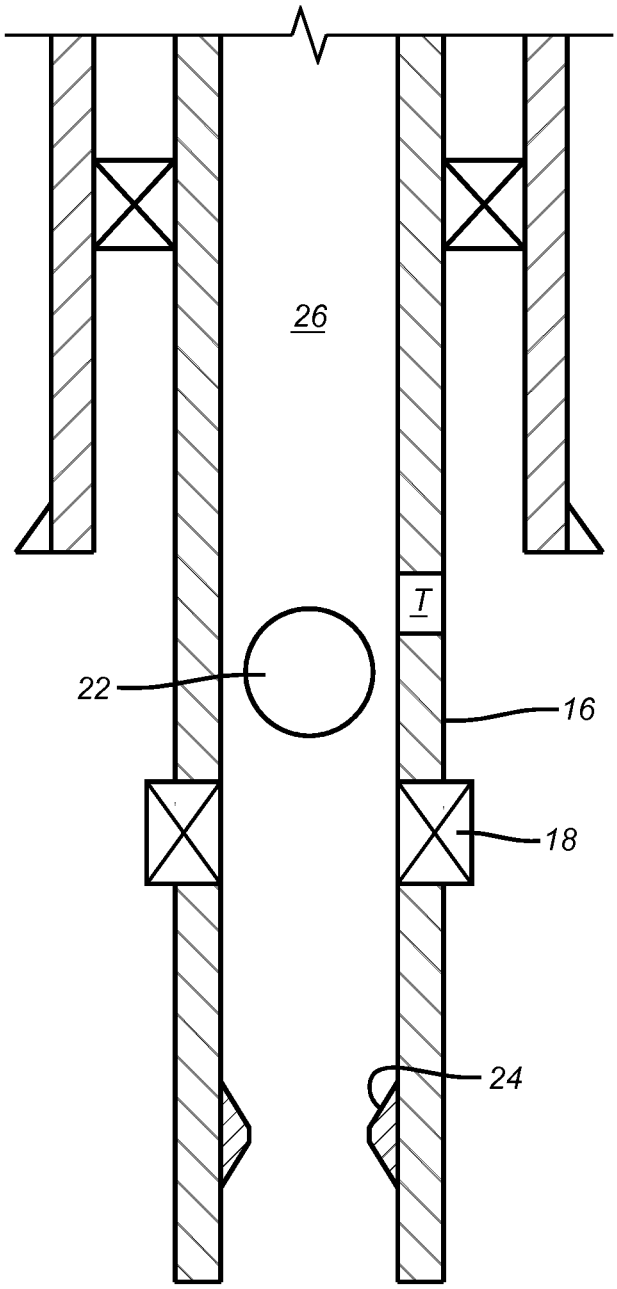
FIG. 4 is an alternative to FIG. 3 showing the magnetic field delivered in a ball dropped or pumped past the tool.

As shown in FIGS. 3 and 4 the magnetic field can be delivered on wireline or slickline 20. The magnetic field can be generated from within an object 22 such as a sphere or a plug or another shape that can clear deviations in a wellbore and can descend with gravitation forces or/and with the aid of circulation of fluid into the bore. The object 22 can also land in a seat 24 to allow a backup way to set the tool 18 using pressure on the seated object 22 in the tubing passage 26. After the tool 18 is set and production begins the object 22 can just be produced to the surface and screened out or it can be blown though the seat 24 or blown with the seat 24 further into the wellbore.

Figure 1A:
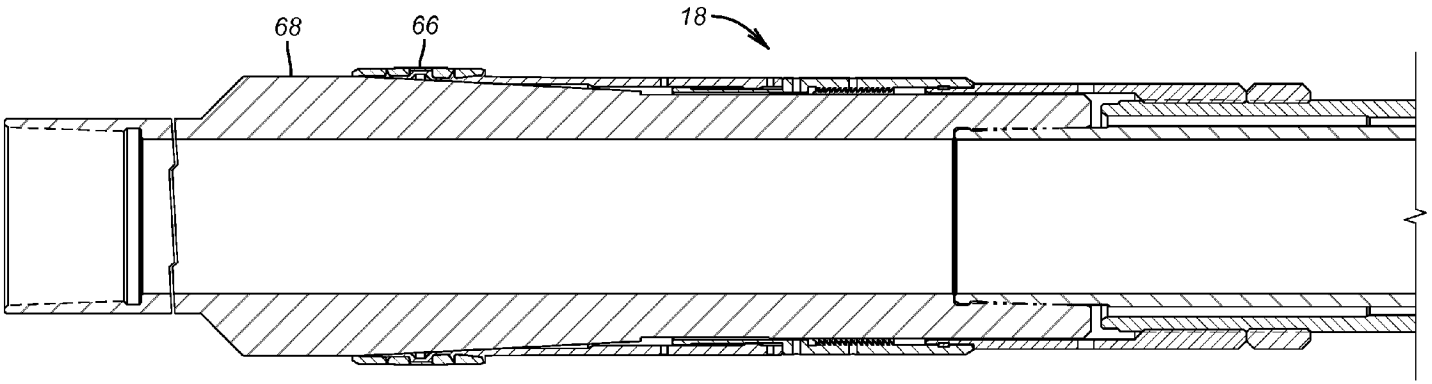
FIG. 1*a*-1*e* shows the set position of the tool in a section view.
Figure 2A:
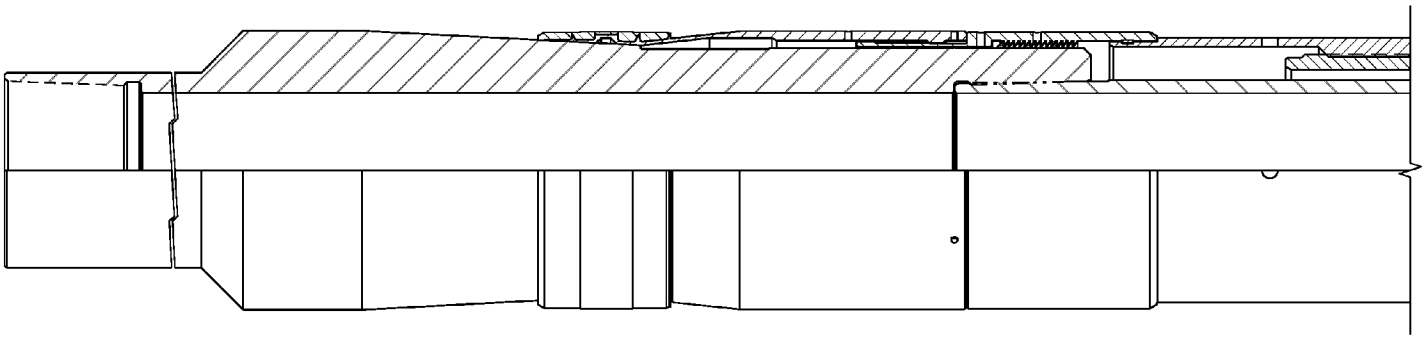
FIG. 2*a*-2*e* is the view of FIG. 1 shown in the run in position.
Figure 1B:
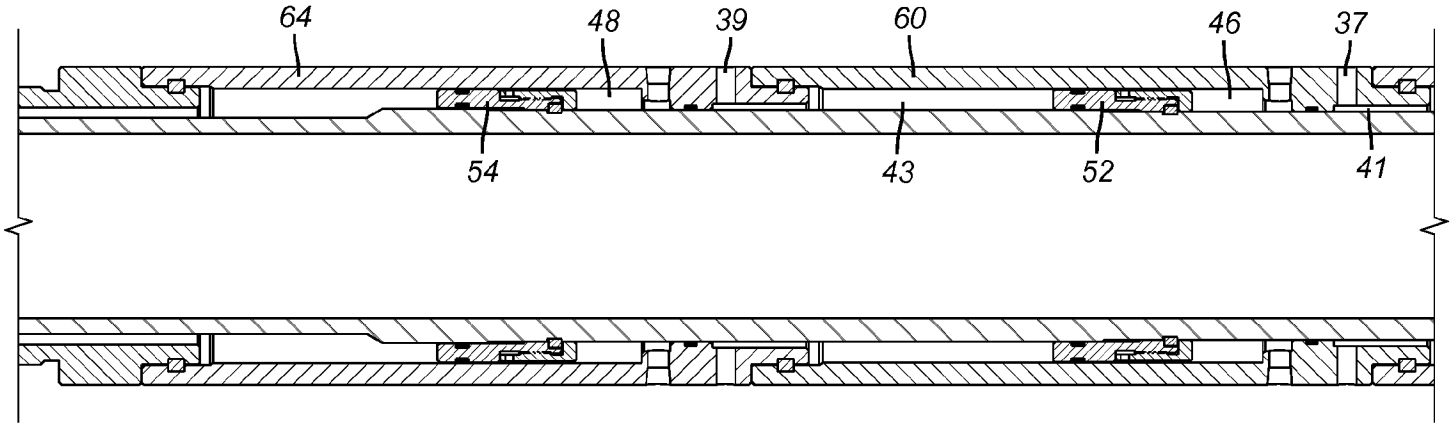
Figure 2B:
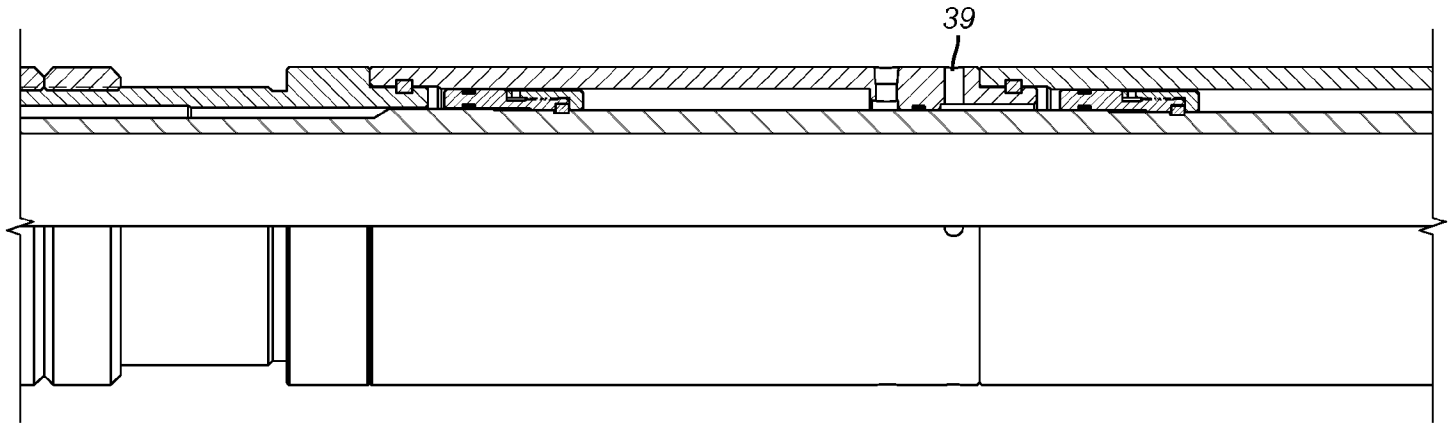
Figure 1C:
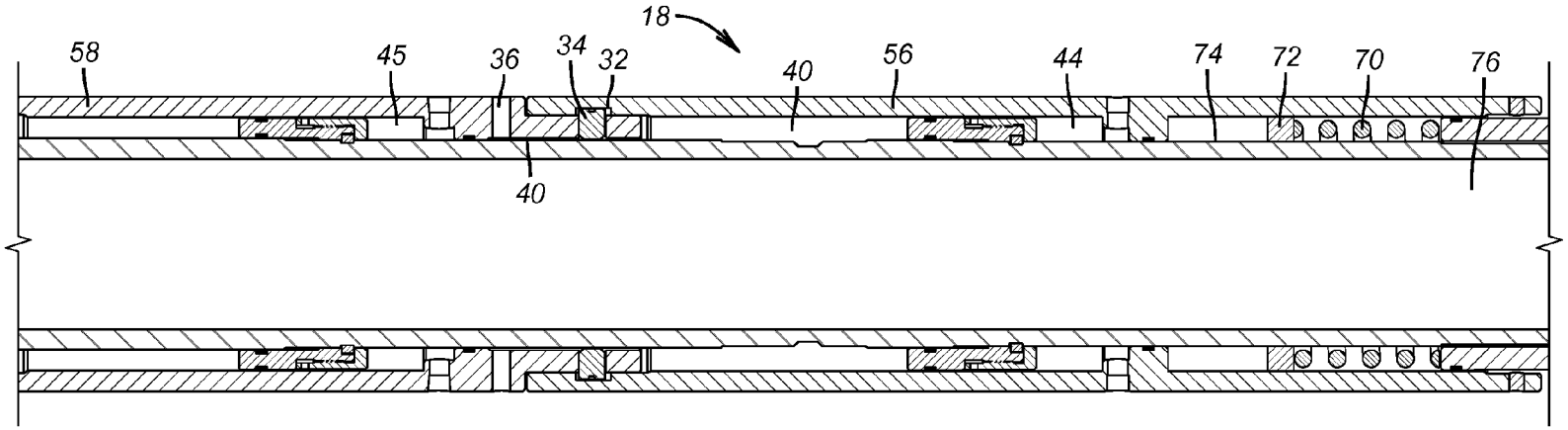
Figure 2C:
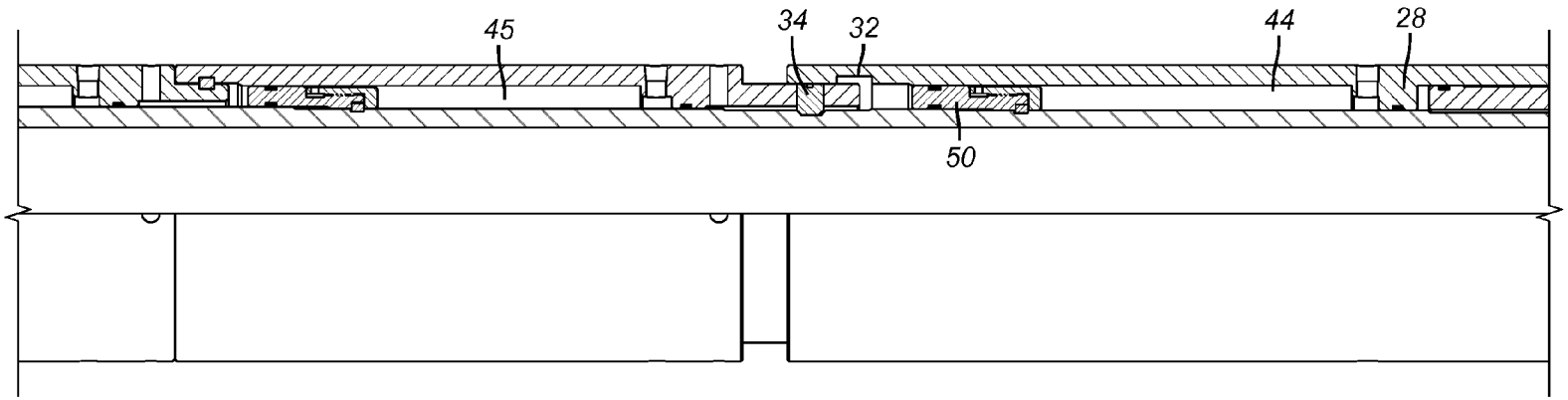
Figure 1D:
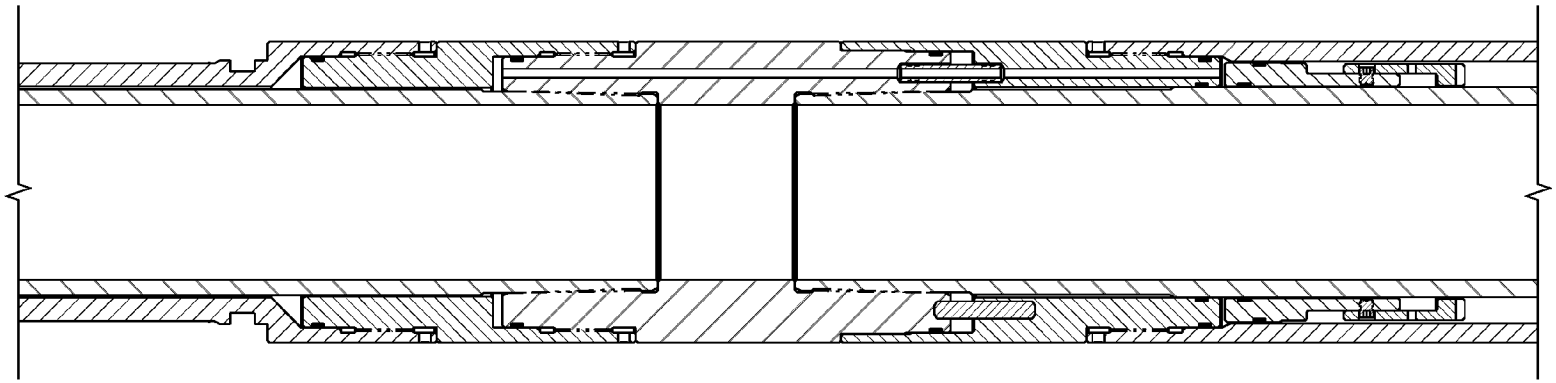
Figure 2D:
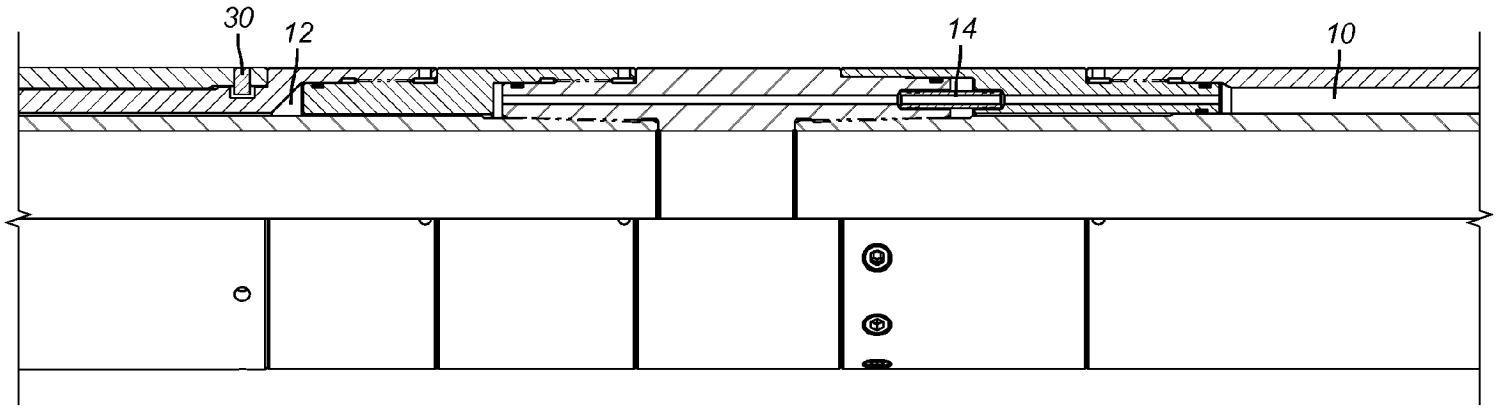
Figure 1E:
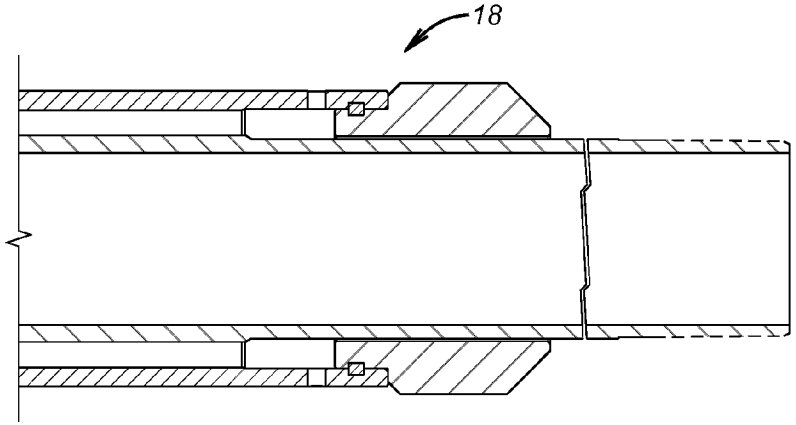
Figure 2E:
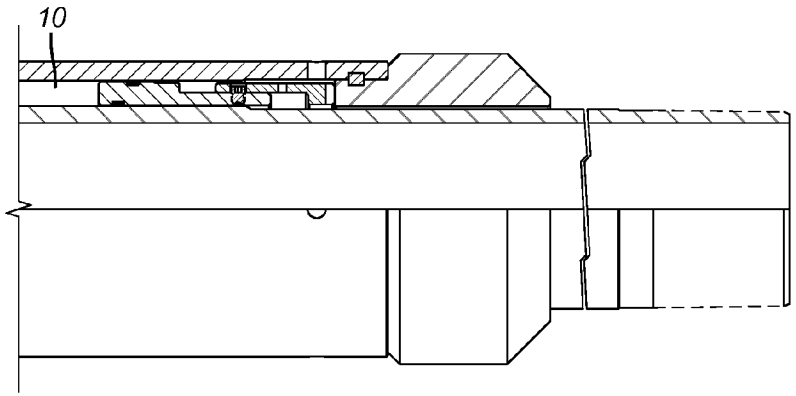

Referring back to FIG. 2*a*-*e* one of the chambers 10 or 12 can have water in them and the other a material that is reactive with water to generate gas pressure against the lock sleeve 28 so as to break the shear pin 30 and align the groove 32 over the lock pin or ring 34 as shown in FIG. 1*c*. When that happens there are open inlet ports 36, 37 and 39 to let in hydrostatic pressure or elevated pressure in the surrounding annulus into spaces 40, 41 and 43 respectively. Atmospheric chambers 44, 45 and 48 are located on opposed sides from barriers 50, 52 and 54 respectively. When the pin 34 is released, the assembly of stacked pistons 58, 60, 62 and 64 can all be driven against the atmospheric chambers 44, 45 and 48 which decline in volume while presenting minimal resistance to piston movement. Ultimately the seal/slip assembly 66 is driven along ramp 68 and against the surrounding tubular to set as shown in FIG. 1*a*.

As described above the generated gas from the reaction is preferably used to release pin 34 so that hydrostatic pressure can be used at the entry ports 36, 37 and 39 to ultimately put the seal/slip assembly 66 in the set position. While a reaction that generates gas can be one way to release the lock in response to a magnetic field as a signal, there are alternatives that can be used in conjunction or as a replacement to the gas generating reaction to release the pin 34 or even to provide the total force needed for a setting of the seal/slip 66. For example, if using an object 22 that lands on a seat 24 it allows the tubing passage 26 to be pressured up. The lock that comprises the pin 34 held by lock sleeve 28 can be urged to move from the FIG. 2*c* to the FIG. 1*c* position the addition of a spring schematically illustrated as 70 that pushes on a block 72 that is tied to the wall 74 of the tool mandrel 76. With pressure in passage 26 the wall 74 flexes and releases the block 72 that remains tied to lock sleeve 28 to move it so as to free the pin 34 to allow the movement needed with hydrostatic pressure as described before to set the element/slip 66. Alternatively a sensor can detect the wall flexing and trigger the tool to actuate using hydrostatic pressure as described above or using a potential energy source deployed to create kinetic energy for actuation. Depending on the amount of axial movement and force required to set the tool 18, the spring 70 could be used as the setting force instead of hydrostatic for the tool 18. If done this way there are no wall ports on the wall 74 which can be an undesirable feature for some operators in some applications.

Those skilled in the art will appreciate that any type of tool can be magnetically set or have its ability to automatically set based on a timer interrupted with a further ability to set later using a magnetic signal. As a backup the magnetic signaling device can also land on a seat in the tubing to allow pressure buildup in the tubing to trigger a set for the tool. In one way this is done is through wall flexing to release a lock so that the tool can be set with a potential energy force that can be annulus hydrostatic or a compressed gas or spring located in the tool. Alternatively, in some applications where the annulus can be pressurized, the lock can be released from the annulus with applied annulus pressure and the tool then set with pressure differential using annulus pressure. In this case the sleeve 28 is moved with applied annulus pressure above the expected hydrostatic at the setting depth to trigger unlocking and setting the tool.

If triggering the lock with a magnetic field is used the permanent or electromagnet or other source used to generated the recognized field can be delivered on a variety of conveyances or dropped or pumped to the tool. The timer T if triggered when the tool 18 is run in will simply unlock the lock in the form of pin 34 without need of a magnetic field to trigger lock release. Preferably a discrete magnetic field is used to stop the timer T as opposed to providing the signal to unlock so that the tool 18 then sets. These differences can be in the wavelength or frequency of the field or other ways detectable by the processor associated with the tool 18.

Other types of energy fields are envisioned such as radio frequency, nuclear energy, as well as various types of electric and magnetic fields that can be detected without having a port in a tool mandrel at a location outside the mandrel. The preferred reactant is water reactive aluminum alloy material known as TAFA and sold by Tafa Inc. of New Hampshire, USA.

While the focus of the preferred embodiment has been the use of magnetic fields the scope of the invention encompasses a control device that can set or actuate the tool that has the capability of being stopped before a preplanned condition of any sort occurs and then can be triggered at a later time to set or actuate the tool. If a timer is involved and the time has not expired, the timer can be halted. Thereafter there are options to either restart the timer for the remaining time, reset the timer for the originally set time or some other interval of time or to simply bypass the timer and go directly to tool actuation. If there is no timer and the triggering event has not yet occurred then a signal can stop the tool from setting and a later signal that is the same or different can allow the tool to actuate. The initial triggering event can be pressure, temperature, pH or other wellbore conditions that preexist or that can be created at the desired location such as vibration, pipe wall strain, acoustic pressure pulses or radio frequencies. In essence the setting condition or programmable event can be the timer or timers or existing or created well conditions. When using well conditions and stopping the setting the options for setting the tool are to enable the system to wait for the well condition to exist or to simply enable the tool to immediately set on receipt of the signal. The signal can arrive in the form of balls that are dropped, drop bars, plugs or wiper plugs to name a few options. For most of these options the orientation of the object at well insertion is not material to the ability of the sensor to detect the targeted condition, such as a magnetic field for example. The signal transmitter can be delivered to the desired location by gravity, fluid flow, wireline, electric line, slickline or a tractor, to name a few options. The sensor for the signal can be mounted integrally to a string or in a separate tool mandrel that is part of the string. When using a magnetic signal, for example the housing for the sensor of that signal should not create interference. Thus, a housing for a magnetic field sensor created by a permanent or electromagnet, for example, can be contained in a non-magnetic housing. The sensor for the target condition can be at least partially exposed to well fluids in a tubular string or in a surrounding annular space. Wall openings in the string are preferably avoided to enhance the certainty of separation between the tubing fluid and the surrounding annulus fluids.

The above description is illustrative of the preferred embodiment and many modifications may be made by those skilled in the art without departing from the invention whose scope is to be determined from the literal and equivalent scope of the claims below.

We claim:

1. A method of setting a tool at a subterranean location, comprising:

enabling a setting device associated with the tool to detect at least one signal;

using said setting device for automatic operation of the tool after a time delay;

running the tool toward the desired subterranean location;

manually stopping the setting device from setting the tool with said at least one signal before said time delay runs out;

manually re-enabling said automatic operation of the setting device to set the tool after said stopping, in response to said at least one signal.

2. The method of claim 1, comprising:

providing said setting device on a tubular housing, said tubular housing having no wall openings, to separate fluid in a passage within said tubular housing from fluid in a surrounding annulus to the tubular housing.

3. The method of claim 1, comprising:

using as said signal at least one of time, temperature, pressure, vibration, strain, acoustic pulse, energy field and magnetic field.

4. The method of claim 3, comprising:
providing said magnetic field with permanent or electromagnets.
5. The method of claim 1, comprising:
starting a timer associated with said setting device that is set for a predetermined time;
stopping said timer before said timer times out;
actuating said timer after said stopping for the time remaining of said predetermined time when said timer was stopped, or for a different time, or setting the tool with said setting device without using said timer.
6. The method of claim 5, comprising:
using a first energy field to stop said timer.
7. The method of claim 6, comprising:
using a magnetic field as said first energy field;
providing a backup way to set the tool if said first magnetic field fails to allow said tool to set.
8. The method of claim 6, comprising:
using said first energy field to later reset said timer to zero elapsed time while retaining the total time to actuation.
9. The method of claim 6, comprising:
using a second energy field for setting said tool after stopping said timer.
10. The method of claim 9, comprising:
moving said tool after stopping said timer;
delivering at least one said energy field with an object;
using at least one of gravity, moving fluid, a tractor slickline, electric line or wireline to advance said object past said tool.
11. The method of claim 10, comprising:
landing said object on a seat to enable pressuring up on a tubing wall in a string that delivered said tool;
using pressure built up on said object on said seat as a backup way to accomplish allowing said tool to set.
12. The method of claim 11, comprising:
using for said object at least one of a drop bar, plug, ball, rod, and dart.
13. The method of claim 12, comprising:
making the orientation of said object independent of its ability to function.
14. The method of claim 11, comprising:
flexing said tubing wall to set the tool.
15. The method of claim 14, comprising:
sensing said flexing with a sensor.
16. The method of claim 15, comprising:
using annulus hydrostatic pressure to move at least one piston for setting the tool.
17. The method of claim 16, comprising:
using a plurality of stacked pistons working against low pressure reservoirs to move at least one of a seal and a slip against a surrounding tubular.
18. The method of claim 9, comprising:
making said first and second energy fields magnetic and different than each other.
19. The method of claim 9, comprising:
making said second energy field a magnetic field;
using detection of said second magnetic field to defeat a lock on said tool that prevents the tool from setting.
20. The method of claim 19, comprising:
using said lock to lock at least one piston to a mandrel of said tool.
21. The method of claim 20, comprising:
using a plurality of stacked pistons working against low pressure reservoirs to move at least one of a seal and a slip against a surrounding tubular.
22. The method of claim 21, comprising:
defeating said lock by opening a valve;
allowing the opening of said valve to create pressure on a lock sleeve;
allowing a retainer holding said plurality of of stacked pistons to a tool mandrel to release from said mandrel due to movement of said lock sleeve with said pressure.
23. The method of claim 22, comprising:
initiating a gas producing chemical reaction by opening said valve.
24. The method of claim 20, comprising:
using hydrostatic pressure surrounding said tool to move said piston.
25. The method of claim 24, comprising:
setting at least one of a seal and a slip against a surrounding tubular with movement of said piston.
26. The method of claim 20, comprising:
using a stored potential energy force on said tool to move said piston.
27. The method of claim 9, comprising:
detecting one of said fields with at least one sensor mounted on the tool or the setting device.
28. The method of claim 27, comprising:
running in said tool as part of a tubular string.
29. The method of claim 27, comprising:
forming a housing of the tool, where said sensor is located, of a non-magnetic material.
30. The method of claim 28, comprising:
locating said sensor in at least one groove located on said tubular string.
31. A method of setting a tool at a subterranean location below a surface, comprising:
providing a setting device for the tool on a tubular housing having no wall openings to separate fluid in said housing from fluid in a surrounding annulus to the tubular housing;
running the tool to the desired subterranean location in an automatic mode for a setting device for setting the tool after passage of a predetermined time;
manually overriding said automatic mode of a setting device before said predetermined time expires in the event of a problem reaching the desired subterranean location with said automatic mode enabled;
manually re-enabling said automatic mode for subsequent setting with said setting device when reaching the desired subterranean location or reaching the desired subterranean location and then actuating said setting device with a signal without said automatic mode.

* * * * *